US006659546B2

(12) United States Patent
Schmeing et al.

(10) Patent No.: US 6,659,546 B2
(45) Date of Patent: Dec. 9, 2003

(54) PARTY ENSEMBLE

(76) Inventors: Karl-Heinz Schmeing, Rheiner Strasse 15, 48485 Neuenkirchen (DE); Josef Schmeing, Darlagenstrasse 25, 48485 Neuenkirchen (DE)

( * ) Notice: Subject to any disclaimer, the term of this patent is extended or adjusted under 35 U.S.C. 154(b) by 0 days.

(21) Appl. No.: 10/096,882

(22) Filed: Mar. 13, 2002

(65) Prior Publication Data

US 2002/0129562 A1 Sep. 19, 2002

(30) Foreign Application Priority Data

Mar. 13, 2001 (DE) ..... 201 04 443

(51) Int. Cl.[7] ..... A47B 3/14

(52) U.S. Cl. ..... 297/157.1; 297/184.15; 108/50.12

(58) Field of Search ..... 297/157.1, 159.1, 297/184.1, 184.15, 170, 172; 108/27, 50.12; 135/96, 124, 906

(56) References Cited

U.S. PATENT DOCUMENTS

| | | | | | |
|---|---|---|---|---|---|
| 396,089 | A | * | 1/1889 | Johnson | 297/157.1 |
| 1,941,652 | A | * | 1/1934 | Bellavia | 297/184.15 |
| 2,362,567 | A | * | 11/1944 | La Rue | 135/96 |
| 2,877,827 | A | * | 3/1959 | Anderson | 108/50.12 |
| 3,910,631 | A | * | 10/1975 | Inaba | 135/16 |
| 4,503,780 | A | * | 3/1985 | Apissomian | 108/27 |
| 4,805,541 | A | * | 2/1989 | Drane et al. | 108/27 |
| 6,314,891 | B1 | * | 11/2001 | Larson | 297/158.4 |

FOREIGN PATENT DOCUMENTS

| | | |
|---|---|---|
| DE | 27 56 135 | 8/1978 |
| DE | 299 20 920 | 3/2000 |
| DE | 200 08 992 | 8/2000 |
| GB | 920226 | 3/1963 |
| NL | 7 016 732 | 5/1972 |

* cited by examiner

*Primary Examiner*—Peter R. Brown
(74) *Attorney, Agent, or Firm*—Milde & Hoffberg, LLP

(57) ABSTRACT

So that a device for use at beer gardens, wine gardens, parties, celebrations, or similar is gladly used by guests, is easily erected, and is stable, the tabletop element (1), the seat elements, and the roof element (8) are at least partially connected via a rod system with one another, and the rod system includes support elements that are positioned at least outside the outer circumference limit (14) of the tabletop element (1).

13 Claims, 10 Drawing Sheets

PARTY ENSEMBLE

BACKGROUND OF THE INVENTION

The invention relates to a device for beer gardens, wine gardens, parties, celebrations, or similar.

A device of this type mentioned above is known from DE 200 08 992 U1 for which chair seats are combined with table surfaces. The table surface may be pie-shaped so that several table surfaces together provide a round tabletop. If the table surfaces are square, they result in a rectangular tabletop. A sun umbrella may be attached to the individual table surfaces.

A disadvantage is that the individual chair seats must first be attached to a table surface in order to create a group ensemble. A further disadvantage is that such seating groups are avoided in beer gardens, wine gardens, at parties, and at celebrations, because guests prefer to enjoy their beverages, food, and similar while standing at a taller table.

An umbrella system with an integrated table is known from DE 299 20 920 U1 for which the umbrella is attached to the table frame, whereby the umbrella is attached at another point with the table frame in addition to the umbrella shaft, and in addition may also rest on the ground or floor.

However, these measures are only implemented so that the umbrella system cannot be upset by wind gusts. The further disadvantage that such tables are avoided by guests because of the low seated position is not avoided.

The objective is to further develop a device for beer gardens, wine gardens, parties, celebrations, or similar of the above-mentioned type, so that guests enjoy using them, they may be easily constructed, and they are stable.

SUMMARY OF THE INVENTION

This objective, as well as further objects which will become apparent from the discussion that follows, is achieved, by the invention by a party ensemble system wherein the tabletop element, the seat elements, and the roof element are at least partially connected via a rod system with one another, and the rod system includes support elements that are positioned at least outside the outer circumference limit of the tabletop element.

The advantages achieved by the invention particularly consist of the fact that a party ensemble is created that resembles a bar in its construction. Raised seating elements such as bar stools are grouped about a table element. The roof element is positioned above the table element and the seat elements. The table element, the seat elements, and the roof element are held together by rods so that an ensemble represents a unit. The table element is positioned at a height such that the guests may stand between the individual seat elements. The seat elements are positioned at a height such that the guests may lean against them while standing, or may sit on them. Their feet can be placed on the footrests positioned below the seat elements. Normally, the table feet are located below the tabletop and within its exterior circumference. If the table must in addition support an umbrella, it can easily tip over. By repositioning the support elements outside the exterior circumference, stability increases significantly. If the seat position is above the supporting elements, this contributes to additional stability. The holding element positioned about the table element ensures that guests can easily hold on to the table element in either a standing or a seated position. It is of particular advantage that the individual parts of the rod assembly can be placed together and transported onward. Thus, it is possible to erect the same party ensemble at various locations. The roof element can be folded up and re-erected.

The concept of an erected roof element also includes the possibility that the roof element can be in the form of a sun umbrella with its shaft placed between the seat elements and/or table element.

For a full understanding of the present invention, reference should now be made to the following detailed description of the preferred embodiments of the invention as illustrated in the accompanying drawings.

DESCRIPTION OF THE PREFERRED EMBODIMENT

Figure 1A:
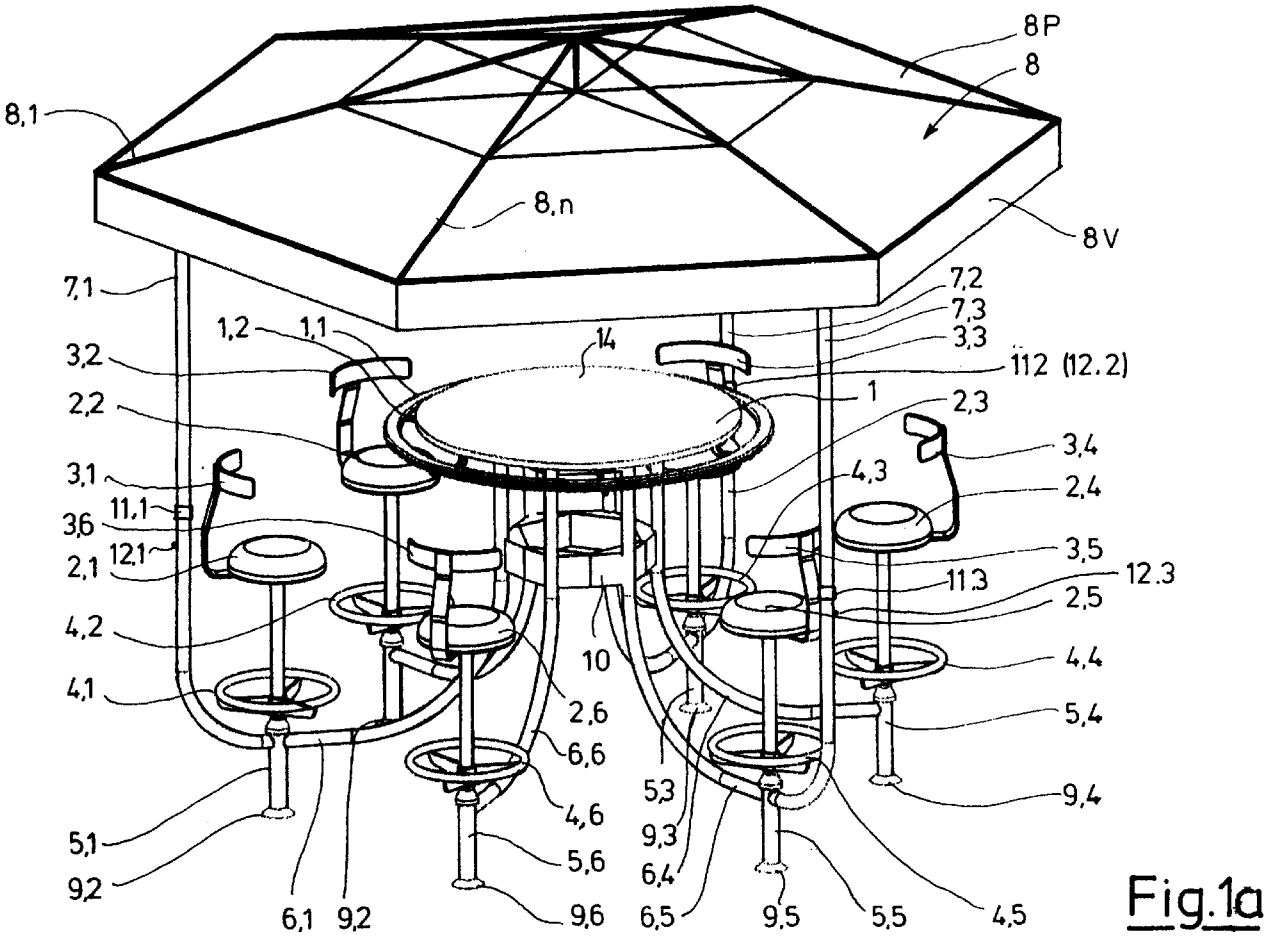
FIG. 1*a*) shows a first embodiment example of a party ensemble in a schematic perspective view.

The preferred embodiments of the present invention will now be described with reference to FIGS. 1*a*–15*e* of the drawings. Identical elements in the various figures are designated with the same reference numerals.

Figure 1B:
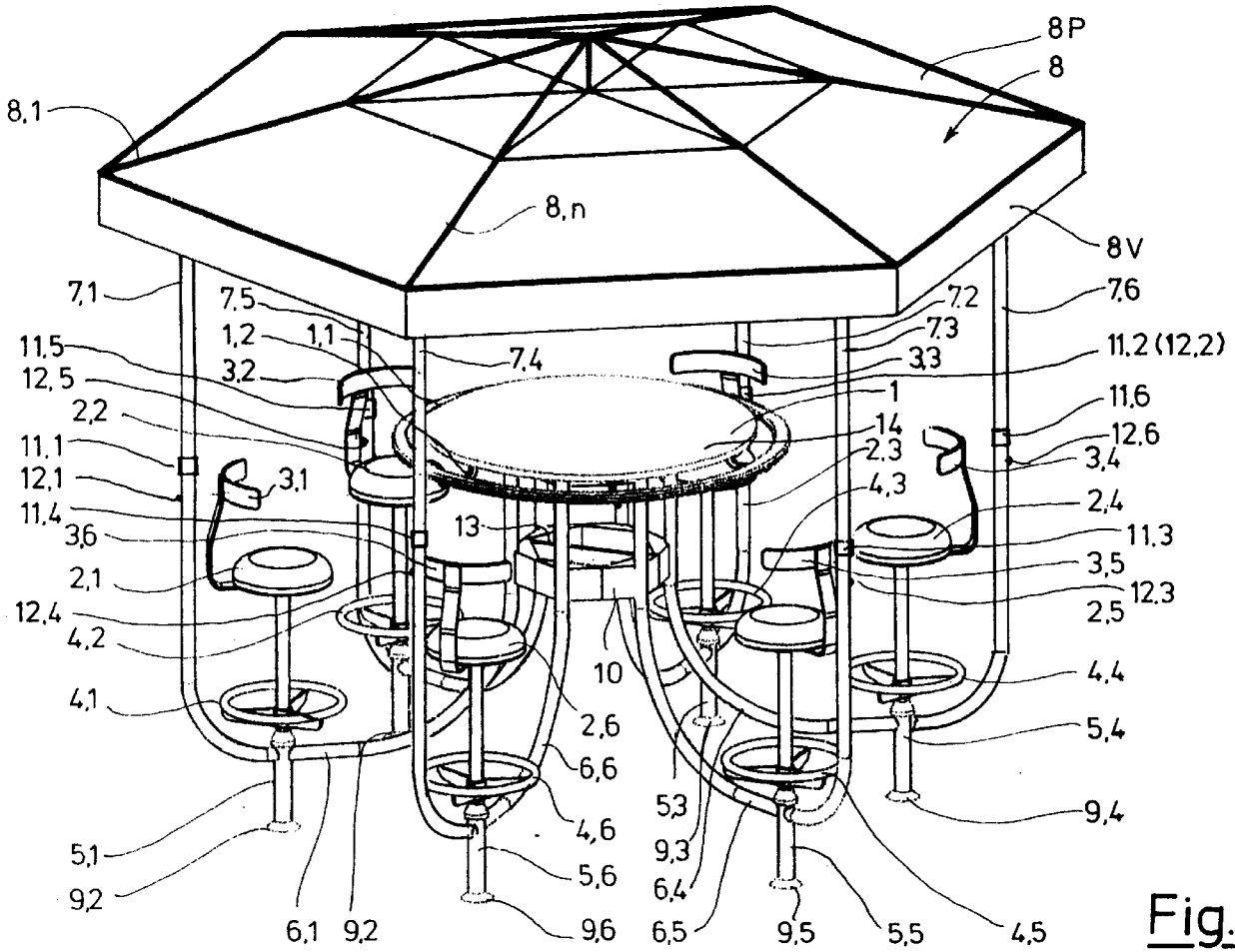
FIG. 1*b*) shows a second embodiment example of a party ensemble in a schematic perspective view.

FIG. 1*a*) shows a first embodiment form of a party ensemble, and FIG. 1*b*) shows a second embodiment form of a party ensemble.

As FIG. 1*a*) shows, six seat elements 2.1, . . . , 2.6 are grouped about a circular table element 1. The circular table element 1 is surrounded by a ring-shaped holding element 1.1 that is connected to the table element 1 by means of holding connecting elements 1.2. A tensioning unit 13 allows tensioning of the table and the holding element. The circular table element 1 and the six seat elements are protected by a roof element 8. The roof element 8 consists of roof ribs 8.1, . . . 8.n that are held together in a conventional manner. A roof cover 8*b* is placed on the roof ribs that covers the seat elements and is surrounded by a roof curtain element 8V. The roof curtain element 8V can be used for advertising or similar.

Each seat element 2.1, . . . , 2.6 is supported by a stool support element 5.1, . . . , 5.6. This results in barstool-type configurations. Each seat element is further provided with a seat back element 3.1, . . . 3.N. On the side opposite the seat element, the stool support element 5.1, . . . , 5.6 includes a support plate element 9.1, . . . , 9.6.

A table top support element 6.1, . . . , 6.6 is provided extending from each barstool support element 5.1, . . . , 5.6 to the table element 1 in such a manner that the circular table element rests on the ends of the table top support elements. The individual table top support elements 6.1, . . . , 6.6 are held together by a support holder element 10 so that they may rotate. Each tabletop support element extends straight from the underside of the table element 1 to end in an arc-shaped quarter-circle in the stool support element.

The hexagonal roof element 8 is supported by three roof holder elements 7.1, 7.2, 7.3. The roof support element 7.1 is positioned to be an extension of the tabletop support element 6.1; the roof holder element 7.2 is positioned to be an extension of the tabletop support element 6.3; and the roof holder element 7.3 is positioned to be an extension of the tabletop support element 6.5. The roof support elements begin within the roof element so that they may end in an arc shape in the stool support element. The arc-shaped formation of the roof holding element and of the tabletop support elements ensures not only a high degree of stability, but also creates an attractive design for the party ensemble.

A foot support element 4.1, . . . , 4.6 is positioned above the tabletop support elements 6.1, . . . , 6.N at the stool support elements 5.1, . . . , 5.6. The foot support element 4.1, . . . , 4.6 is formed as a circular ring that is connected with each stool support element 5.1, . . . , 5.6 by means of three ribs.

The floor support elements, the stool support elements, the tabletop support elements, the roof elements, and the roof ribs 8.1, . . . , 8.N can be made of iron or metal tubes. Aluminum tubes are particularly well suited for this since they may be easily shaped and their surfaces may be easily treated. It is also possible, of course, to use fiberglass tubes. Further, it is possible to use round or rectangular bar stock instead of tubes.

The one shown in FIG. 1*b*) is different from that in FIG. 1*a*) in that six roof holder elements 7.1, . . . , 7.6 are now used, instead of three. Each of the six tabletop support element 5.1, . . . , 5.6 is provided with a roof holder element 7.1, . . . , 7.6 that then become six tabletop support elements 6.1, . . . , 6.6. This increases stability.

In the party ensemble shown in FIG. 2, it is clear that the roof holder element 7.1, . . . can be positioned directly below the seat element 2.1, . . . . Also, the foot support element 4.1, . . . can be shaped as a step. Since the individual tabletop support elements 6.1, . . . and the individual roof holding elements 7.1, . . . are curved in an arc, the party ensemble presents an attractive appearance.

Figure 3A:
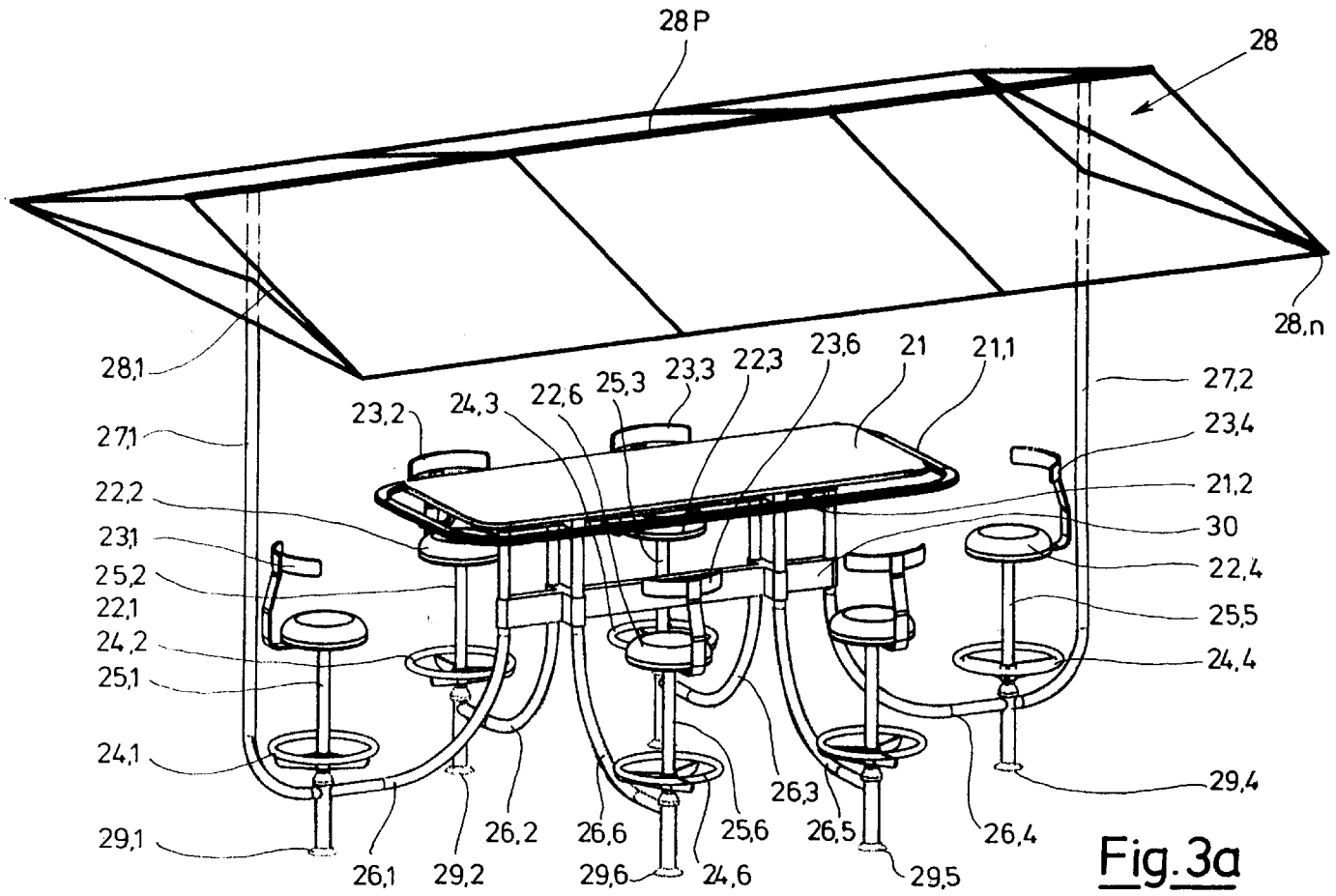
FIG. 3*a*) shows a second embodiment example of a party ensemble in a schematic perspective view.

FIGS. 3*a*) and 3*b*) show another embodiment example of a party ensemble.

Here, a rectangular table element 21 is used around which six seat elements 22.1, . . . , 22.6 are grouped. The six seat elements and the rectangular table element 21 are covered by a rectangular roof element 8. This roof element 28 consists of roof rib elements 28.1, . . . , 28.n that are covered by a roof plate element 28P.

Each seat element 22.1, . . . , 22.6 is supported by a stool support element 25.1, . . . , 25.6.

While the stool support elements 5.1, . . . , 5.6 are covered by a supporting plate element 9.1, . . . , 9.6, the stool support elements 25.1, . . . , 25.6 end in a support plate element 29.1, . . . , 29.6. This ensures that the stool support elements cannot be pressed into a soft ground or floor surface.

A tabletop support element 26.1, . . . , 26.6 extends from each stool support element 25.1, . . . , 25.6 to below the rectangular tabletop element 21. The individual tabletop support elements 26.1, . . . , 26.6 are held together by a supporting rotating mount 30.

A ring-shaped formed foot support element 24.1, . . . , 24.6 is positioned above each tabletop support element that is attached to the stool support element 25.1, . . . , 25.6.

A roof holding element 27.1 extends from the stool support element 25.1 to the roof element 28. On the opposite side, a second roof holding element 27.2 extends from the stool support element 25.5 to the roof element 28. Both roof holder elements ensure that the roof element 28 is held securely above the table element 21 and the six seat elements.

Aluminum tubing or similar is also used to form the rods for the second embodiment example of the party ensemble.

Figure 3B:
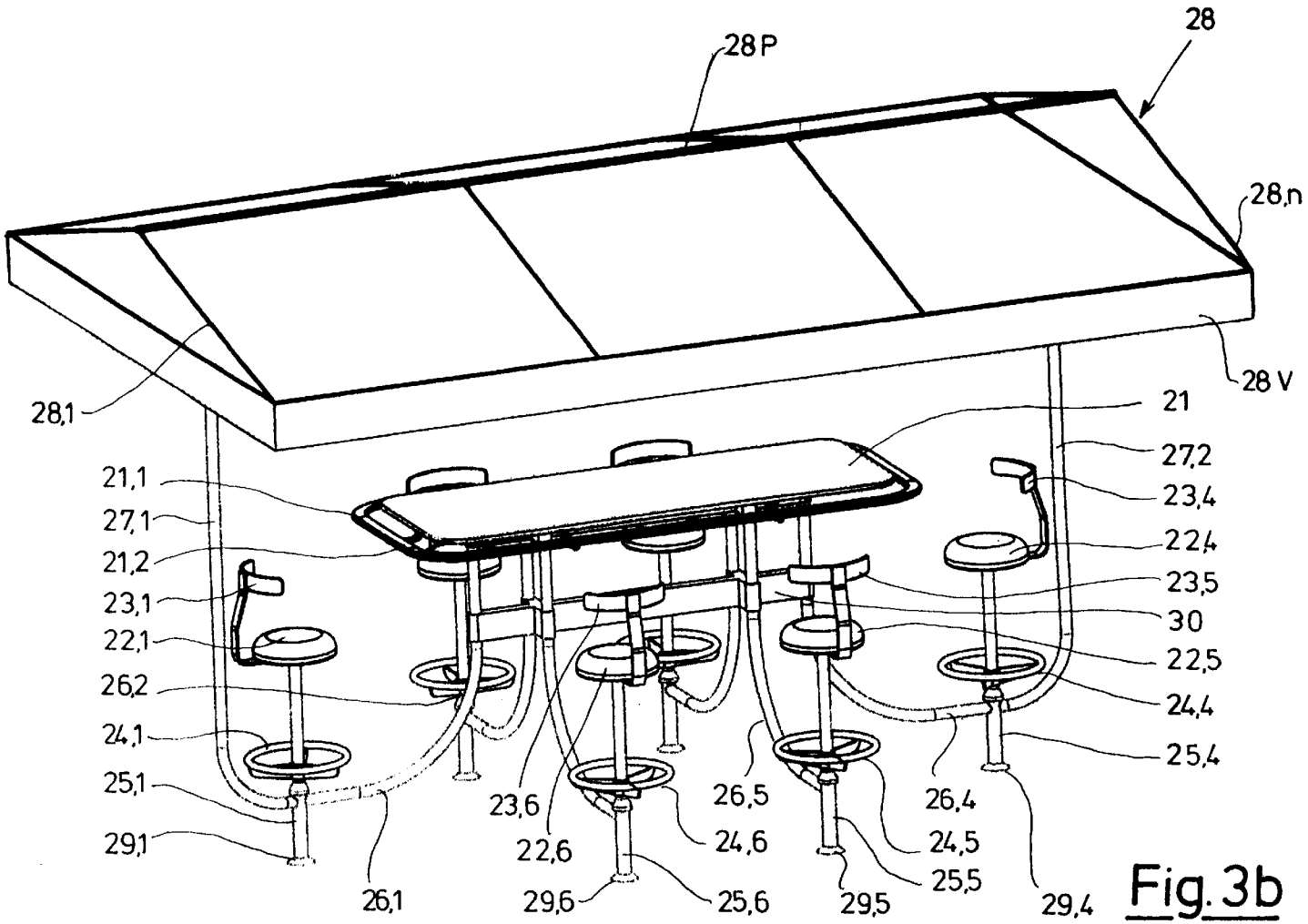
FIG. 3*b*) shows a second embodiment examples of a party ensemble with a roof curtain in a schematic perspective view.

The party ensemble in FIG. 3*b*) is also constructed the same as the one in FIG. 3*a*). However, the roof plate element 28P of the roof element 28 is surrounded by a roof curtain element 28V at its ends. This roof curtain element 28V can also be used for advertising purposes or similar.

FIGS. 4 through 14 show possible embodiment examples of various party ensembles.

Figure 4:
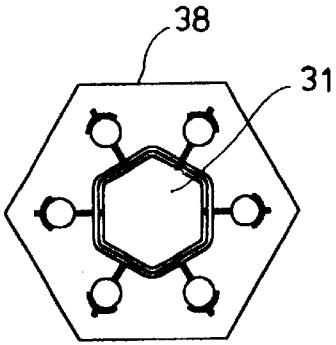

FIG. 4 shows a party ensemble that consists of a hexagonal tabletop element 31 and a hexagonal roof element 38. Six seat elements are grouped about the hexagonal table element 31.

Figure 2:
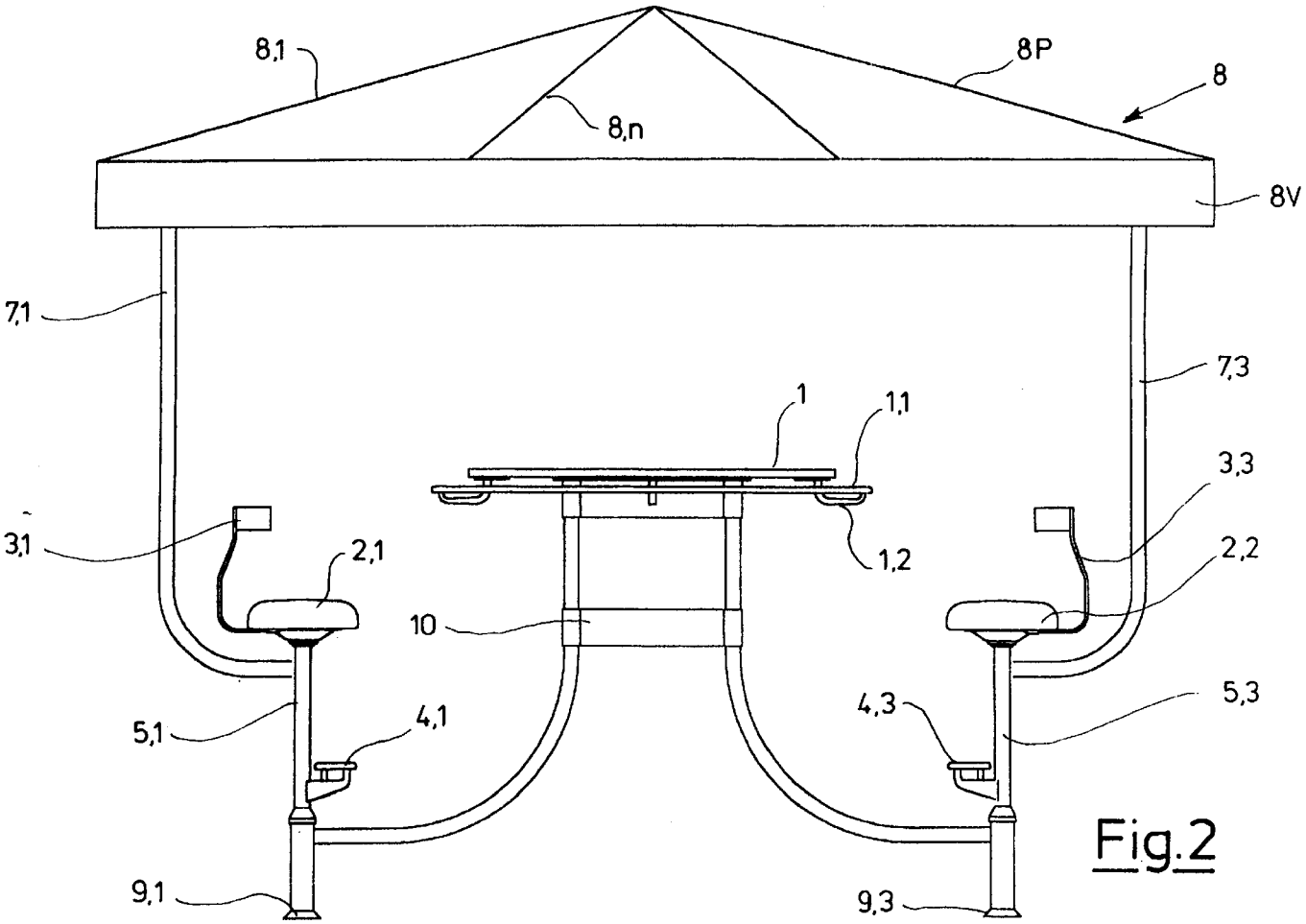
FIG. 2 shows a transformed first embodiment example of a party ensemble in a schematic side view.
Figure 5:
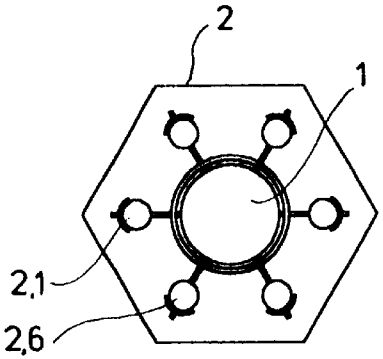

FIG. 5 shows the first embodiment example of the party ensemble described above that consists of a round tabletop element 1 and a hexagonal roof element 2 and was shown in FIGS. 1 and 2 and was described in detail using these illustrations.

Figure 6:
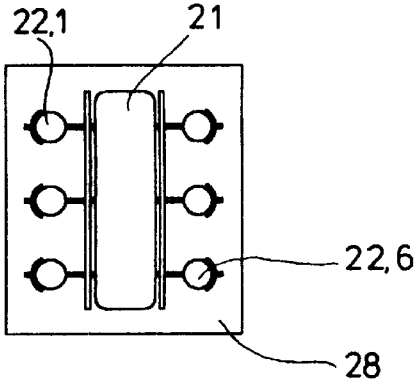
FIGS. 4 to 14 show various embodiment examples of party ensembles in a schematic overhead view.

FIG. 6 shows a party ensemble that includes a rectangular-shaped tabletop element 21 that is covered by a rectangular roof element 28.

Six seat elements 22.1, . . . , 22.6 are grouped about a rectangular-shaped tabletop element 21. However, the six seat elements here are positioned on the opposing long sides of the tabletop element 21, in contrast to the party ensembles of the second embodiment type shown in FIGS. 3*a* and 3*b*. The holding element here consists of two transfixing rods that are secured to the tabletop element 21 by holding elements as shown in FIG. 1.

Figure 7:
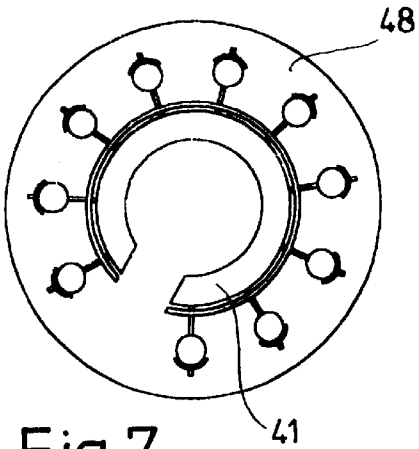

FIG. 7 shows another, very interesting embodiment example of a party ensemble. It includes a tabletop element 28 with an essentially Ω-shaped form when seen from above, about which ten seat elements are grouped. In contrast to the other tabletop elements, the option exists here to provide service to guests from within the tabletop element 41. Both the serving person and the guests seated on the individual seat elements are covered by an essentially round roof element 48.

Figure 8:
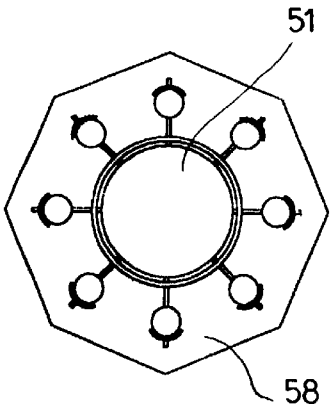

FIG. 8 shows a round tabletop element 51 that is covered by a hexagonal roof element 58.

Figure 9:
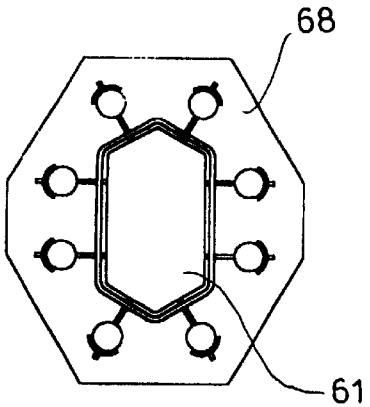

FIG. 9 shows a benzene-ring hexagonal tabletop element 61 with a matching benzene-ring hexagonal roof element 68. Since both the table element and the roof element are widely separated from each other by the benzene-ring shaped configuration, several persons can be seated here, and can enjoy food and beverages.

Figure 10:
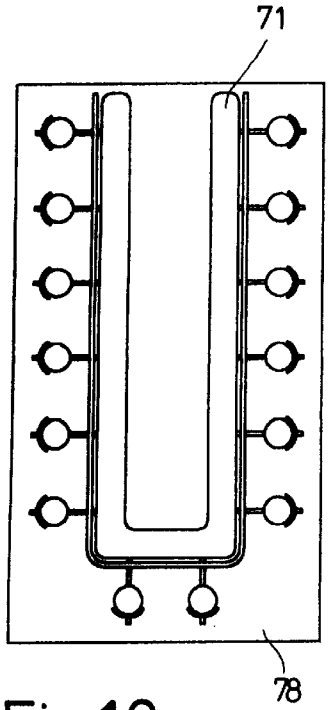
Figure 15A:
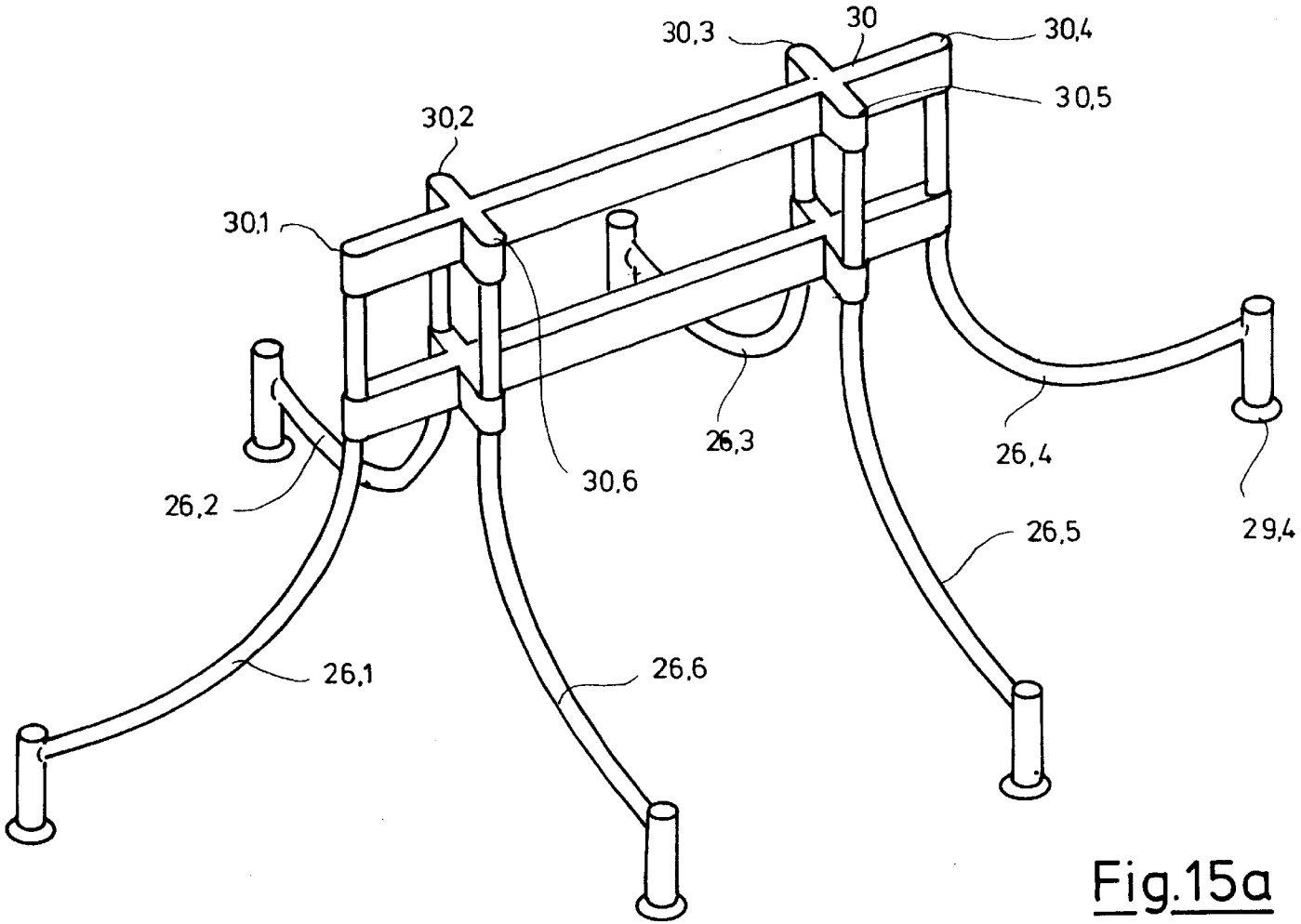
FIGS. 15*a*) to 15*e*) show the lower frame of a party ensemble according to FIGS. 3*a*) and 3*b*) in various assembly configurations.
Figure 15C:
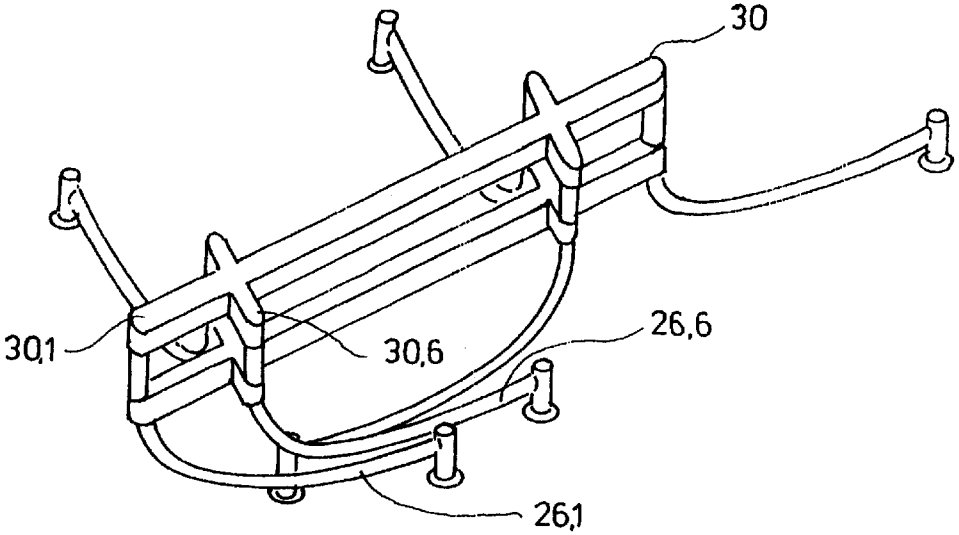
Figure 15B:
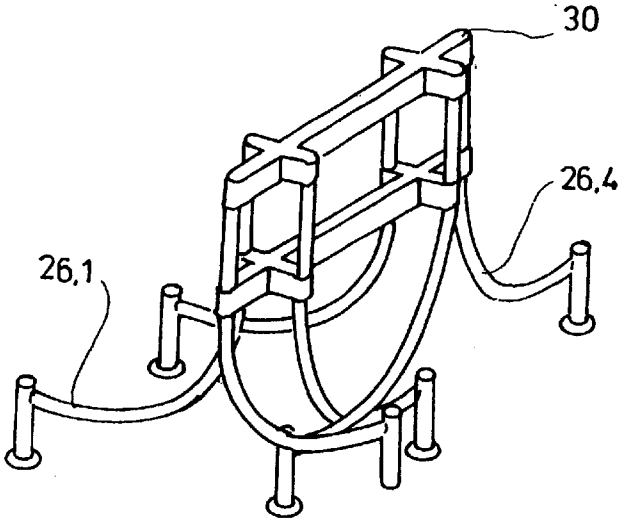
Figure 15E:
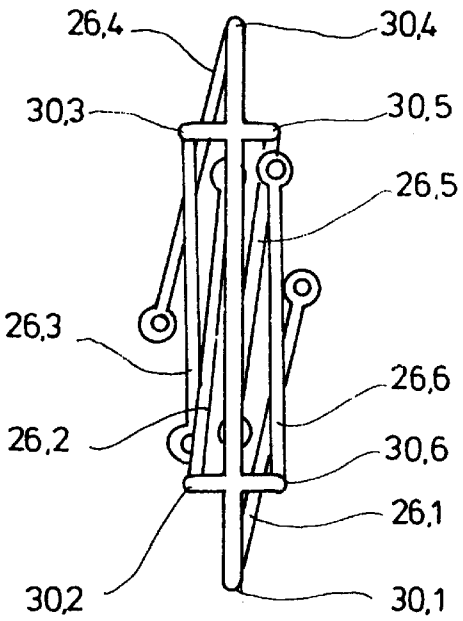
Figure 15D:
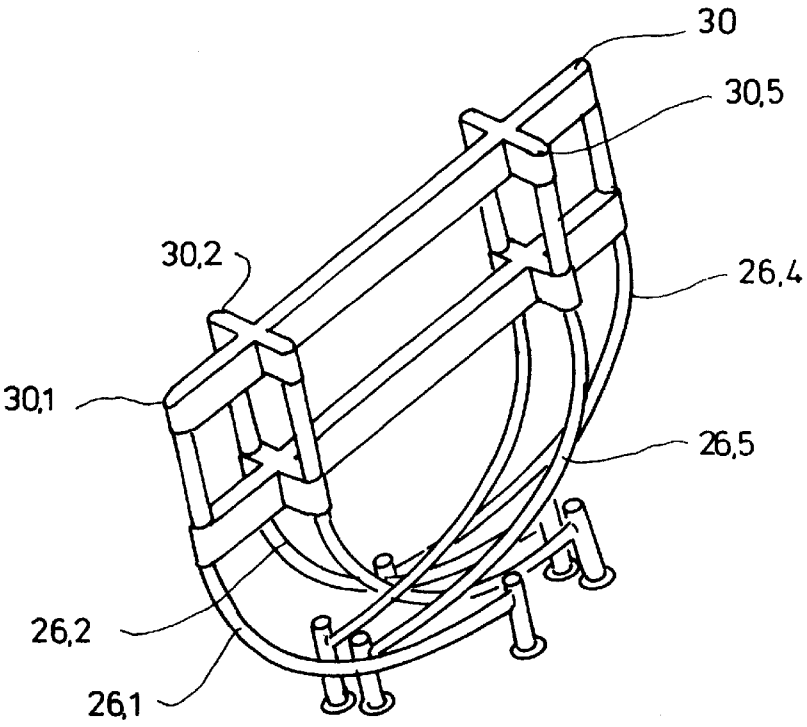

FIG. 10 shows a party ensemble that includes a U-shaped tabletop element 71, about which 14 seat elements are grouped. The seat elements and the U-shaped tabletop element 71 are covered by a rectangular roof element 78. A party ensemble so shaped is particularly suited for clubs or groups. The U-shaped configuration of the tabletop element 71 allows service personnel to enter the tabletop element and to serve each guest individually with the food and beverage he has ordered without having to reach over his back. Soiling of the guest's clothing during serving is avoided. Individual service is provided that may be addressed to the individual worthiness and honor of each guest.

Figure 11:
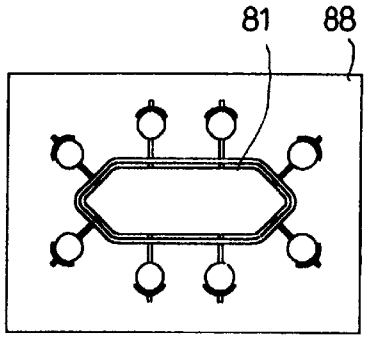

FIG. 11 shows a party ensemble that includes a hexagonal tabletop element 81. The hexagonal tabletop element 81 is rather narrow, so that such a table is best suited for beverages. The tabletop element and the eight seat elements grouped about it are covered by a rectangular roof element 88.

Figure 12:
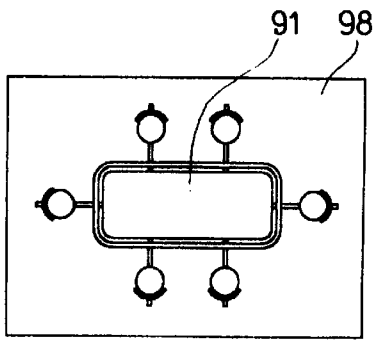

FIG. 12 shows a rectangular tabletop element 91 that is covered by a rectangular roof element 98. Only six seat elements are generously grouped about the rectangular tabletop element so that individual guests have plenty of room to celebrate.

Figure 13:
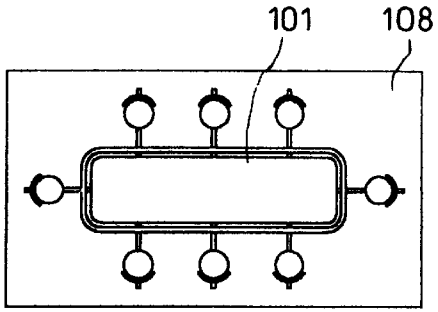

FIG. 13 shows a rectangular tabletop element 101 that is likewise covered by a rectangular roof element 108. In contrast to tabletop element 91, tabletop element 101 is longer, so that two persons have more room.

Figure 14:
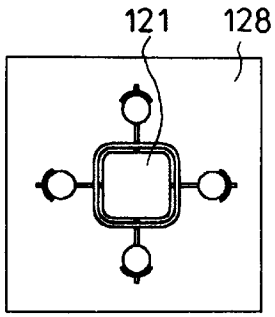

FIG. 14 shows a party ensemble suitable for a small group. Here, only four seat elements are grouped about a square tabletop element 121. A square roof element 8 covers the tabletop element 121 and the four seat elements.

It should be mentioned at this point that the configurations are not limited to the shapes of tabletop elements described. Both the tabletop elements and the roof elements can be octagonal, dodecagonal, etc.; they can also be shaped as ellipsoids, or rhomboids.

The lower frame has great significance for the party ensemble. FIGS. 15*a* through 15*e* show the lower frame for the party ensemble according to FIGS. 3*a* and 3*b*.

The support holding element 30 includes individual support rotational-mount elements 30.1, . . . , 30.6 in which the ends of the tabletop support elements 26.1, . . . , 26.6 are positioned. The support rotational-mount elements are so shaped that the individual tabletop support elements can be locked or rotated.

When the lower frame is folded together, the opposing tabletop support elements 26.1 and 26.4 are first folded inwards. Both tabletop support elements rotate within the support rotational-mount elements 30.1 and 30.4. Next, the other tabletop support elements 26.2, . . . are rotated within the other support rotational-mount elements 30. The lower frame previously widely deployed has its outer dimensions reduced to about 1/20—of the previous ground space requirement. Thus, it is possible both to carry the lower frame and to transport it easily. During transport, little cargo space is required in the transporting vehicle.

If the party ensemble according to FIGS. 3 *a*) and 3*b*) is required for a beer- or wine-party, the lower frame and the other parts of the party ensemble may be loaded onto a truck.

After arrival at the beer- or wine-party location, the lower frame is erected first. For this, the individual tabletop support elements 26.1, . . . , 26.6 are so rotated within the individual support rotational-mount elements 30.1, . . . , 30.6 so that the individual tabletop support elements 26.1, . . . , 26.6 are placed into their final position. Finally, they are locked and erected.

As FIGS. 15*a* through 15*e* show, the individual tabletop support elements 26.1, . . . , 26.6 contain the lower sections of the stool support elements 25.1, . . . , 25.6. Therefore, the remaining ends of the stool support elements are inserted into the space available after erection of the individual tabletop sectional elements, and thus the individual seat elements 22.1, . . . , 22.6 are suitably grouped with the seat back elements 23.1, . . . , 23.6 located on them. The rectangular tabletop element 21 with the holder element 21 located on it is positioned onto the other ends of the tabletop section elements and the support holder element 30. The holder element 21 is connected with the tabletop element 21 by means of individual holder connector elements 21.2.

Once the individual seat elements and the tabletop element are positioned, the two roof holder elements 27.1 and 27.2 are inserted into the two stool support elements 25.1 and 25.4. For this, the roof holder element 27.1 or 27.2 consisting of a straight and a curved section of rod can be fitted together.

It is possible that the straight rod sections of the opposing roof holder elements 27.1 and 27.2 have already been inserted into the roof rib elements 28.1, . . . , 28.n of the roof element 8, so that the entire roof may be positioned above the individual seat elements and tabletop element in one simple step.

Finally, the connected roof rib elements 28.1, . . . , 28.n are covered by the roof cover element 28P. If a roof cover element 28P with a roof curtain element is used, the roof curtain element 28V is lowered on all sides.

Several party ensembles so erected may be positioned on one floor surface. Quick, easy erection of the party ensemble is possible because of the lightness of the rods and the individual parts according to FIGS. 3*a*) and 3*b*).

Once assembly is complete, celebration may begin. The particular configuration of individual seat elements allows guests to stand around the rectangular tabletop element 21 and to speak animatedly. They have the option while standing of leaning against the seat elements. During calmer times, they can seat themselves on the seat elements 22.1, . . . , 22.6. The particularly high position of the individual seat elements 22.1, . . . , 22.6 are suited to celebration habits. The guests have the option of leaving their seats very quickly and moving to another table, or to other positions of the same table, which is complicated in a normal seated position by the need to push the stool back and similar.

The seating of the guests on individual seat elements and the direct connection of the roof element with the table element and seat elements via the rods ensure that the party ensemble is [not] blown away by an approaching storm or similar. Even if guests are not seated at the party ensemble, it is ensured that it cannot tip.

It is possible to configure the individual roof holder elements to telescope, with telescoping elements 11.1, . . . , 11.6 and unlocking button (see particularly FIGS. 1*a* and 1*b*). This allows the roof element to be lowered and the tabletop element and the seat elements to be protected from rain and similar. The roof cover element hanging down provides additional protection for the seat elements. It can be so configured that no dirt or rainwater or similar may be blown in from the side.

If the celebration is to be continued on the following day, the telescoping roof holder element needs only to be extended. Thus, the roof element may be regrouped with respect to the tabletop element and the individual seat elements with a few simple steps.

There has thus been shown and described a novel party ensemble which fulfills all the objects and advantages sought therefor. Many change, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirt and scope of the invention are deemed to be covered by the invention, which is to be limited only by the claims which follow.

What is claimed is:

1. A table-seat combination for beer gardens or similar, comprising in combination:

(a) a tabletop element having a circumferential limitation;

(b) a plurality of individual seat elements, each seat element comprising a stool for supporting a single person;

(c) a roof element, under which the tabletop element and the seat elements are positioned;

(d) an arrangement of rods connecting the tabletop element and the seat elements with one another, said rod arrangement including a plurality of stool support elements, supporting the seat elements; and (e) a plurality of roof holding elements supporting the roof element, each roof holding element being positioned outside the circumferential limitation of the tabletop and being connected to a stool support element at a point beneath the respective stool.

2. A table-seat combination as in claim 1, wherein the tabletop element and the seat elements are shaped like a bar, whereby, similar to bar stools, the seat elements can be used either by standing persons to lean on or as a seat.

3. A table-seat combination as in claim 1, wherein the rods of the rod arrangement are at least one of insertable into each other, boltable together and foldable.

4. A table-seat combination as in claims 1, wherein the roof holder elements are connectable in a telescope-like manner, capable of being inserted into each other, the roof element being adjustable in height with respect to the tabletop element using said roof holder element.

5. A table-seat combination as in claim 1, wherein the roof holder elements extend with curved shape into the stool support elements.

6. A table-seat combination as in claim 1, further comprising tabletop support elements, disposed beneath the tabletop element, which are held together by a support holder element, in an at least partially rotatable manner.

7. A table-seat combination as in claim 1, further comprising at least one foot rest element, located below at least one seat element, which is at least partially connected with the stool support element of the respective stool.

8. A table-seat combination as in claim 1, further comprising a back rest element located on at least one seat element.

9. A table-seat combination as in claim 1, further comprising a holding element at least partially surrounding the tabletop element.

10. A table-seat combination as in claim 1, wherein the tabletop element includes holding connection elements for connecting the tabletop element and the holding element.

11. The table-seat combination as in claim 10, further comprising a bracing device for bracing the tabletop element and the holding element.

12. A table-seat combination as in claim 1, wherein the tabletop element has a shape selected from the group consisting of circular, rectangular, hexagonal, Ω-shaped, U-shaped and cube-shaped.

13. A table-seat combination as in claim 1, wherein the roof element has a shape selected from the group consisting of circular, rectangular, hexagonal, Ω-shaped, U-shaped and cube-shaped.

* * * * *